US005090353A

United States Patent [19]

Ellis

[11] Patent Number: 5,090,353

[45] Date of Patent: Feb. 25, 1992

[54] OPEN CELLULAR CONTAINERSHIP AND METHOD

[76] Inventor: Wilfred Ellis, 124 Walker Street, N. Sydney, NSW, Australia, 2060

[21] Appl. No.: 352,709

[22] Filed: May 11, 1989

Related U.S. Application Data

[63] Continuation of Ser. No. 44,276, Apr. 27, 1987, abandoned.

[30] Foreign Application Priority Data

Jul. 8, 1985 [AU] Australia ..... 44673/85
Jul. 8, 1986 [AU] Australia ..... PCT/AU86/00195

[51] Int. Cl.[5] ..... B63B 25/00
[52] U.S. Cl. ..... 114/72; 114/75
[58] Field of Search ..... 114/72, 75, 74 A, 26, 114/84, 85, 183 R, 184, 259, 260

[56] References Cited

U.S. PATENT DOCUMENTS

| | | | |
|---|---|---|---|
| 1,806,651 | 5/1931 | Schmidt | 114/183 R |
| 2,242,635 | 5/1941 | Whittelsey | 114/72 |
| 2,840,027 | 6/1958 | Chapman et al. | 114/183 R |
| 2,963,310 | 12/1960 | Abolins | 114/72 |
| 3,380,422 | 4/1968 | Bachko | 114/72 |
| 3,440,990 | 4/1969 | Van Riet et al. | 114/72 |
| 3,537,414 | 11/1970 | Goldman | 114/72 |
| 3,583,350 | 6/1971 | Goldman | 114/72 |
| 3,818,852 | 6/1974 | Lewis et al. | 114/72 |
| 3,827,384 | 8/1974 | Lunde et al. | 114/75 |
| 3,934,530 | 1/1976 | Kossa et al. | 114/260 |

FOREIGN PATENT DOCUMENTS

| | | | |
|---|---|---|---|
| 502923 | 6/1976 | Australia . | |
| 2512379 | 9/1976 | Fed. Rep. of Germany | 114/72 |
| 2823782 | 12/1979 | Fed. Rep. of Germany | 114/75 |

OTHER PUBLICATIONS

"The Twinstar", Nord-Marine Inc., date unknown.

*Primary Examiner*—Ed Swinehart
*Attorney, Agent, or Firm*—Richard C. Litman

[57] ABSTRACT

A containership (1) having a superstructure which comprises a hull, a container bearing deck (2) located beneath the waterline, sidewalls (3, 4) which extend upwardly from the container bearing deck to define a container hold (5) located within the hull. At the top of the walls is a strength deck (8) whose position approximates the position of the uppermost row of containers (9) when the ship is fully laden. The elongate sidewalls (3, 4) restrain the containers and provide a weather shield.

1 Claim, 2 Drawing Sheets

FIG. 1

OPEN CELLULAR CONTAINERSHIP AND METHOD

Figure 1:
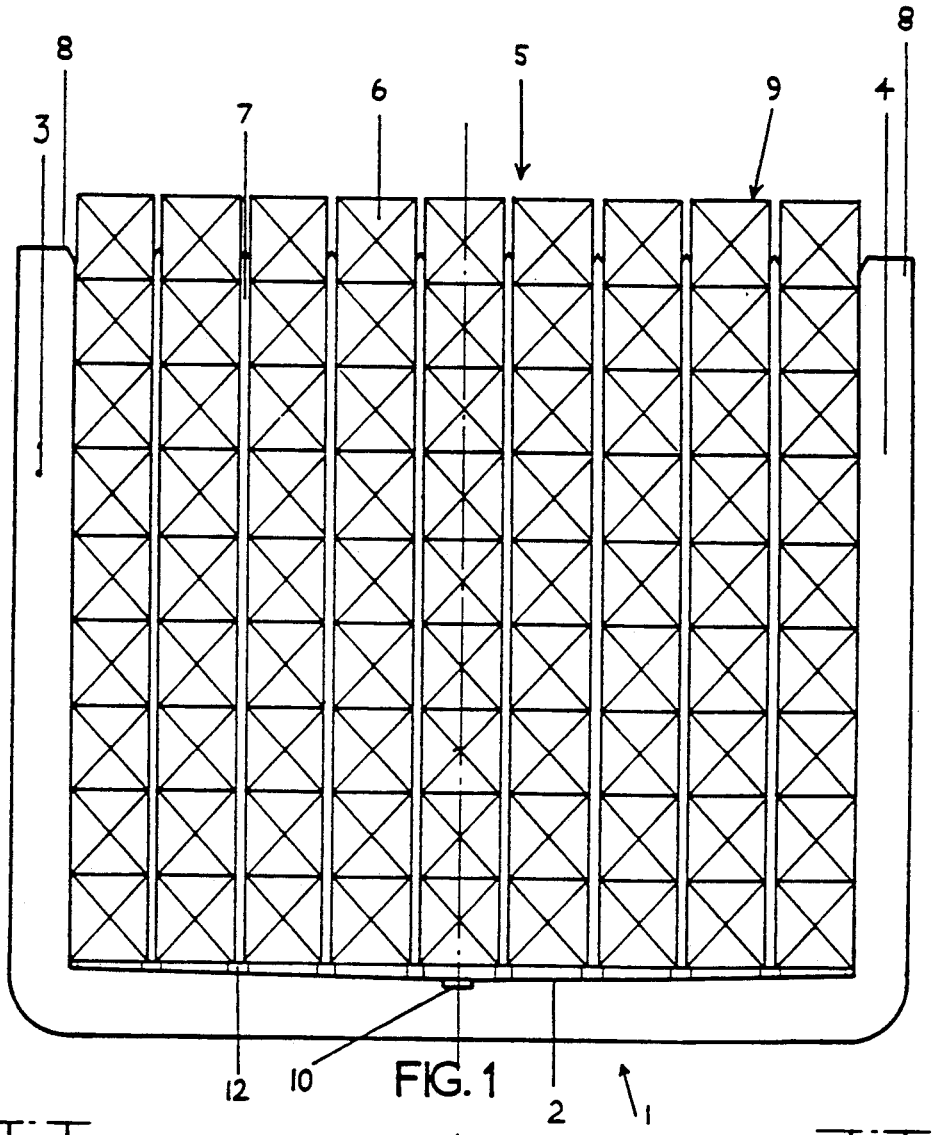

This is a continuation of application Ser. No. 07/044,276, filed Apr. 27, 1987, now abandoned.

This invention relates to improvements in containerships and in particular it relates to improvements intended to increase the speed of handling containers both into and out of a cellular type containership and to increase the security of containers normally carried on the deck of containerships by altering the structural configuration of the superstructure of conventional containerships.

The present method of lifting containers out of a typical containership or lowering them into the hold, is to stack the containers in a cellular vertical guidance system, and when several adjacent stacks reach the height of the hatch coamings, these stacks are covered by steel hatch covers which serve the dual purpose of sealing the hold spaces against entry of water and to provide a platform for those containers which are to be carried on deck.

In the prior art containerships it is necessary to remove the hatch covers in order to gain access to any containers which are located in the hold, and this means that all containers mounted on the hatch cover above the container(s) required must first be removed to a container stack or holding area ashore.

The hatch covers themselves are of heavy and robust construction in order to withstand the substantial forces due to the weight of containers stacked on them and to resist the acceleration forces due to the ship's motion in a seaway.

In modern cellular containerships, approximately 40% of the total number of containers carried may be carried on the hatch covers and must be secured to the deck by means of substantial lashing fittings. These lashing fittings must be secured manually before the ship can safely proceed to sea.

It may be seen therefore that the process of removing deck containers and hatch covers for access to below-deck containers and the securing of exposed deck containers is expensive in time and effort, thus adding to the cost of unloading and loading the ship.

In addition, containers which are mounted on deck and secured to hatch covers are exposed to the vagaries of the seas and have been, on occasions, lost overboard or the containers have been damaged and their contents lost overboard or damaged by sea-water. Such accidents add to the insurance costs of cargo thus increasing the cost of goods to the consumer.

Due to the fact that cargo containers are seldom completely filled with cargo, the centre of gravity of a stack of containers is considerably higher than the centre of gravity of a comparable weight of cargo when stowed in the conventional manner in the hold of a general cargo vessel. This fact, coupled with the practice of carrying three or four tiers of containers on top of the hatch covers, requires particular care to be taken to achieve and maintain adequate positive ship stability.

In the past, it has been known to stack containers in a vertical alignment, (as is disclosed in German Patent Specification number 7529350-1975), such that the weatherdeck comprising the hatches and an upper container bearing deck is eliminated. This enables more efficient storage of containers due to space economy. In German specification, the stability and security of the containers is intended to be achieved by the use of under deck guide rails being extended uninterrupted above the weather deck level.

In the aforesaid German specification the longitudinal coamings on each side of the cargo hold extend over the entire cargo hold area and transverse coamings are only provided on the ends of the longitudinal coamings This arrangement is intended to prevent water from the weatherdeck entering the cargo hold.

Further, releasable protecting devices are provided for the sides of the containers which are above the deck to prevent water entering the hold. These devices may be in the form of spray walls which are intended to absorb the movements and forces generated by the bending of the ship.

Also disclosed are means for casting containers overboard.

Surge walls can also be located between the guide-rails to minimise the amount of water entering the hold.

In contrast, the present invention provides a means for the restraint of and for the protection from sea surge and spray of containers.

This is achieved by increasing the height of the walls of the ship resulting in an increase in the depth of the ship and a consequent increase in the freeboard.

The increased wall depth obviates the need for coamings, detachable sea walls, extended guide rails, and any lashings for the containers.

The increased wall depth results in the strength deck on top of the wall approximating the position of the uppermost container when the ship is fully laden.

The deeper ship beam allows a narrower wall width due to increased resistance to bending. It also provides improved torsional resistance in the container ship. The deeper ship beam also allows less steel to be used in the ship wall without compromise to the overall structural integrity of the ship. The present invention simplifies the containership superstructure's configurational design and raises the weather deck to a point whereby the containers are better protected from the elements. The elongated ship wall also provides built in restraint for the containers when the containership pitches and rolls and virtually eliminates the possibility of containers falling into the sea during transit in heavy seas.

It has not hitherto previously been known to provide a containership having a container bearing deck below the water line and at the same time having the strength deck positioned such that all containers are protected by the ship wall structure instead of with extension structures from an abbreviated wall as is the case with the prior art.

Throughout the specification the term 'weatherdeck' applies to those decks on a ship which are exposed to the elements; the term strength deck applies to the longitudinal structural member or box girder which runs along the top of the ship walls; the term 'freeboard' applies to the vertical distance between sea level and the upper surface of the strength deck.

The present invention seeks to ameliorate the aforesaid shortcomings of the prior art containership loading configuration and method of containment of cargo by providing an open hull into which containers can be stacked on top of each other in vertical alignment said containers being retained in position and stabilised by an extended ship sidewall.

This invention reduces the time taken to remove or exchange containerised cargo because no lashing of containers is required. The containers are restrained by the ships sides which are extended higher than normal to support the uppermost tier of containers.

In its broadest form the present invention comprises a container carrying ship having a superstructure comprising:

a hull;

a container bearing deck located beneath the water line;

sidewalls extending upwardly from the said container bearing deck to define a container hold located within the said hull; and a strength deck at the top of said sidewalls; wherein when the said hold is fully laden with containers, the depth of the said sidewalls is such that the position of the said strength deck approximates the position of the uppermost container, the side walls thereby providing support for and a weathershield for the containers.

In the preferred embodiment the containship is essentially 'U' shaped in cross section with the walls being extended to a depth considerably greater than has been known previously This is achieved together with the elimination of the conventional coamings and hatches.

Figure 2:
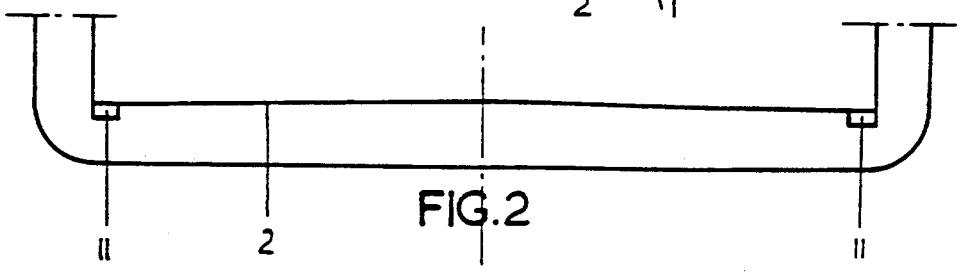
Figure 3:
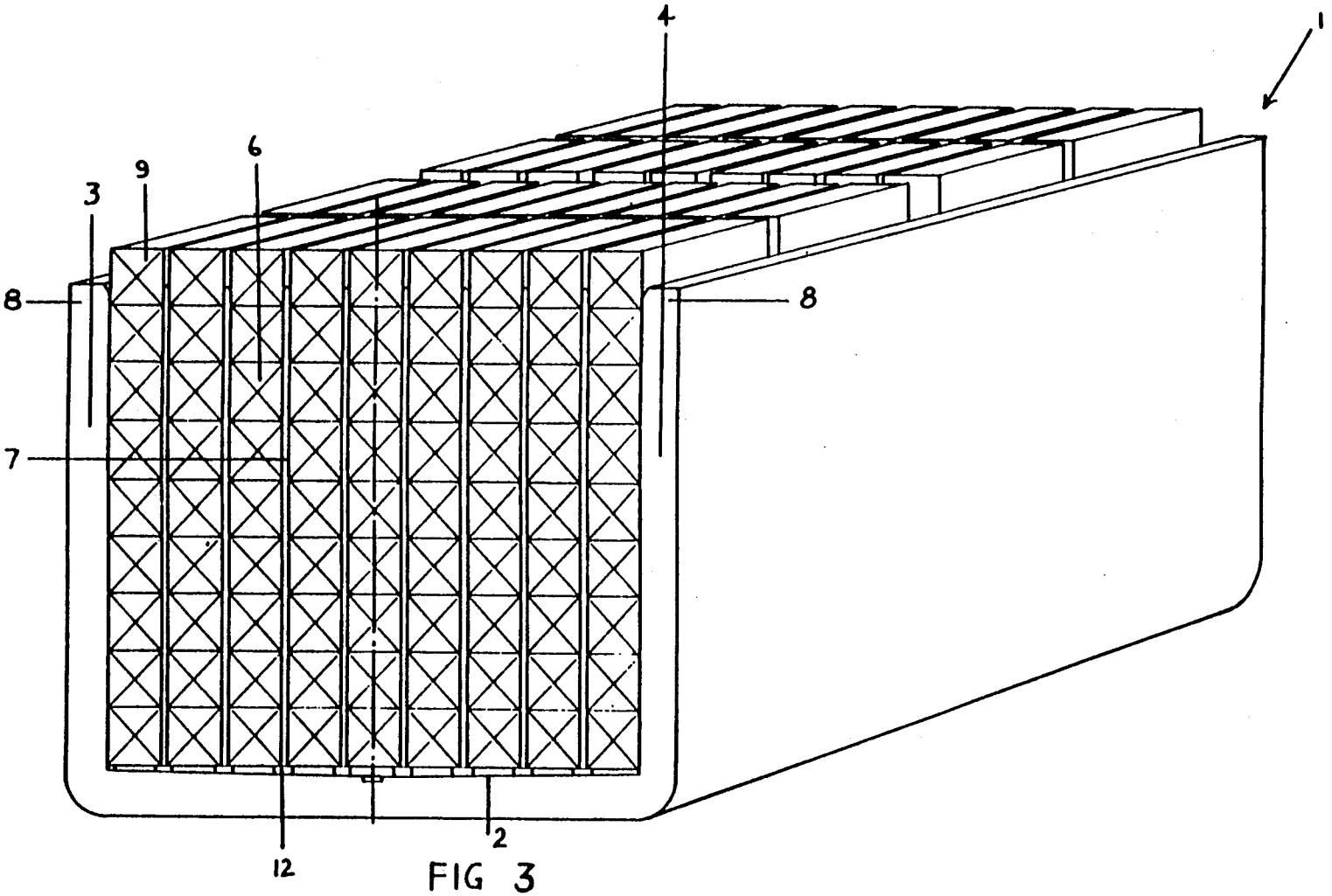

In order to achieve the elongated ship walls the box girder forming the strength deck and the wall structure require redesigning. The present invention will now be described in detail according to a preferred but non limiting embodiment and with reference to the accompanying illustrations wherein:

FIG. 1 shows a midship cross sectional view of a containership superstructure according to the preferred embodiment of the present invention;

FIG. 2 shows an abbreviated cross sectional view of the container leaving deck having alternative means for drawing bilge water; and FIG. 3 depicts an isometric view of a midship portion of a containership of indefinite length. Referring to FIG. 1 there is shown a midship section of a typical ship carrying nine containers high and nine containers wide. It is feasible to employ a number of varied loading configurations within the ship structure depending upon the particular size of a containership.

The containership section shown comprises a substantially U shaped hull 1 having a container bearing deck 2 and sidewalls 3 and 4. The container bearing deck 2 is, when the ship is floating, below sea level. A hold 5 is formed by the clear passage which exists within the deck 2 and the walls 3 and 4. The containers 6 are placed in hold 5 in the configuration shown in FIG. 1. The containers can be retained transversly and equidistantly by guides 7. The walls 3 and 4 have been made narrower than in conventional containerships because the thickness can be reduced as a result of a deeper ship beam. At the top of walls 3 and 4 is a box girder forming a strength deck 8.

The strength deck 8 is substantially in alignment with the uppermost row of containers 9 and thereby provides lateral restraint and weather protection for the containers.

Along with the considerably increased wall depth FIG. 1 also shows that the normal hatch coamings, hatch covers and associated lashing devices which are used in the prior art containerships are eliminated. The freeboard of the vessel is increased proportionally and side plating extended up, adjacent to the uppermost row of containers 9 in the stack, thus affording protection of all containers against heavy weather damage.

The necessary structural strength is obtained by the inclusion of transverse members and bulkheads, (not shown), appropriately positioned along the length of the containership.

The container bearing deck 2, as depicted in FIG. 1, is inwardly cambered towards a centrally located drain 10. The camber is so designed to facilitate the progress of bilge water toward the drain so it can be subsequently pumped out. Although the elongated walls 3 and 4 provide significant protection for the containers against the elements it is inevitable that some water either from rain or spray will enter the ship. This necessitates the provision of a means for drawing and pumping the water.

To cope with any accumulation of rainwater or spray on the double bottom tank top of the vessel, each hold may be appropriately divided to reduce free surface effects to a minimum and suitable hold pumping arrangements provided. Various methods may be used for keeping the holds drained of rainwater and spray and FIGS. 1 and 2 show two alternative methods of draining to bilge hat boxes or drains 11 recessed in the double bottom of the ship.

In FIG. 2 the container bearing deck 2 is adapted with bilge hat boxes at its lateral extremities.

The double bottom tank top may be straight and not cambered as shown in FIGS. 1 and 2 with suitable drainage and pumping arrangements provided.

FIG. 3 shows an isometric view of the midship portion of a ship fully loaded with containers.

The containers 6 are shown bearing on support rails 12 running longitudinally along the ship hull.

This view makes it apparent that there is no need for additional structures or attachments such as coamings or sea walls beyond the sidewalls 3 and 4 to retain or protect the containers.

The vessel may therefore be fully loaded without the use of any lashing devices for the containers. The stability of the vessel is improved and any container may be accessed by the removal of a minimum number of other containers.

It will be recognised by persons skilled in the art that numerous variations and modifications can be made to the invention without departing from the overall spirit and scope of the invention as broadly described herein.

I claim:

1. A method for loading and transporting a load of containers on a voyage, comprising the following steps:

selecting a containership having a container-bearing deck normally located below a water line and sidewalls extending upwardly from said container-bearing deck, said sidewalls being constructed to provide support and weather shield protection;

situating a longitudinally disposed strength deck at a top of each sidewall substantially above said waterline, said container-bearing deck and sidewalls defining therebetween an open and uncovered hold for receiving the containers, said hold being constructed to be used without lashing devices or hatch covers;

selecting the height of the sidewalls sufficiently high so the height of the strength deck approximates the height of an uppermost container when the containership is fully loaded;

fully loading the selected containership by loading the containers in rows and columns stacked one upon another upon said container-bearing deck such that the height of the strength deck approximates the position of the uppermost container when the hold is fully laden with containers; and maintaining the open hold uncovered throughout a voyage between two different ports; whereby said containership may be fully loaded while improving the stability of the containership.

* * * * *